US006276816B1

(12) United States Patent
Dozsa-Farkas et al.

(10) Patent No.: US 6,276,816 B1
(45) Date of Patent: Aug. 21, 2001

(54) RADIATION-DEFLECTING SYSTEM, IN PARTICULAR A LIGHTING SYSTEM

(75) Inventors: Andras Dozsa-Farkas, Müenchen; Sybille Fleckenstein, Wiesbaden, both of (DE)

(73) Assignee: Zumtobel Staff GmbH, Dornbirn (AT)

( * ) Notice: Subject to any disclaimer, the term of this patent is extended or adjusted under 35 U.S.C. 154(b) by 0 days.

(21) Appl. No.: 09/387,845

(22) Filed: Sep. 1, 1999

Related U.S. Application Data

(63) Continuation of application No. PCT/EP98/02630, filed on May 4, 1998.

(51) Int. Cl.[7] ..... F21V 7/00

(52) U.S. Cl. ..... 362/268; 362/282; 362/319; 362/322; 362/283; 362/147

(58) Field of Search ..... 362/277, 280, 362/281, 282, 283, 319, 322, 268, 147, 148

(56) References Cited

U.S. PATENT DOCUMENTS

| | | | | |
|---|---|---|---|---|
| 4,337,506 | | 6/1982 | Terada | 362/142 |
| 5,005,931 | * | 4/1991 | Mori | 362/283 |
| 5,276,601 | * | 1/1994 | Holzhacker | 362/354 |
| 5,988,841 | * | 11/1999 | Simon | 362/551 |

FOREIGN PATENT DOCUMENTS

| | | |
|---|---|---|
| 0652399A1 | 5/1995 | (EP) . |
| 862073 | 3/1961 | (GB) . |
| 2229291A | 9/1990 | (GB) . |
| 87 06995A | 11/1987 | (WO) . |

* cited by examiner

*Primary Examiner*—Thomas M. Sember
(74) *Attorney, Agent, or Firm*—Fitzpatrick, Cella, Harper & Scinto

(57) ABSTRACT

A radiation-deflecting system is disclosed which can be used in particular as a lighting system for rooms, halls, stores or the like. This radiation-deflecting system includes at least one radiation source, such as a high power light source, which emits parallel radiation such as a parallel light beam. In the path of radiation (16) of the radiation source there are arranged a plurality of partially transparent mirrors (2), in spaced apart arrangement, which serve as radiation distributing elements (1) and are arranged to be rotatable around the radiation axis and around a second axis perpendicular thereto. The partially transparent mirrors (2) are preferably exchangeable. With the aid of the partially transparent mirror of the radiation distributing element (1) a part of the radiation is branched off and deflected and directed to a predetermined desired location. If applicable, further optical elements (9, 10) such as lenses, filter, slides, colour filters or the like can be arranged downstream of the partially transparent mirror which forms the main part of the radiation distributing element (1). Preferably, the support (11) for downstream optical elements (9, 10) forms a complete functional unit with the rotational mounting for the partially transparent mirror (2) and a curved supporting and guiding device (5).

14 Claims, 4 Drawing Sheets

RADIATION-DEFLECTING SYSTEM, IN PARTICULAR A LIGHTING SYSTEM

CROSS REFERENCE TO RELATED APPLICATIONS

This is a continuation of co-pending International Application No. PCT/EP98/02630, filed May 4, 1998.

BACKGROUND OF THE INVENTION

1. Field of the Invention

The invention relates to a radiation-deflecting system, in particular to a lighting system, having at least one radiation source (a light source) which emits parallel radiation (a light beam).

Although in the case of the invention it is the field of application of a lighting system that is mainly in the foreground, in accordance with the principles of the invention other kinds of radiation, such as infrared radiation or the like, can also be redirected in a spatially distributed manner and be branched off.

2. Description of the Related Art

In the case of the main field of application of lighting, previously in the rooms, halls or the like to be illuminated it was usual to provide lighting means which are to be connected to a corresponding power source and the corresponding switching devices. For this purpose, it was necessary to lay electric power lines to the desired connection points for the lighting means, which lines always had to be relaid when spatial changes were made. In the case of the usual design forms for the lighting, the current was sent to the lights or lighting means so that a plurality of corresponding current terminals in accordance with the number of lighting means and lighting fixtures to be provided were required. This is not only troublesome, but also time-consuming and in particular it is questionable whether utilization is effective and energy-conscious in this connection.

In comparison with this, the invention aims to provide a radiation-deflecting system, in particular a lighting system, which permits utilization that is comparatively favourable in terms of energy and which also permits flexibility, even when it is applied in large spaces or when the distances that are to be covered are long.

SUMMARY OF THE INVENTION

In accordance with the invention to this end a radiation-deflecting system, in particular a lighting system, is provided that has at least one radiation source (a light source) emitting parallel radiation (a light beam) and which is distinguished by the fact that arranged so as to be spaced apart in the path of radiation of the radiation source there are a plurality of mirrors, which can be rotated about the radiation axis and which are preferably exchangeable, as radiation-distributing elements that direct a portion of the radiation (of the light) to predetermined desired locations. In the case of the radiation-deflecting system in accordance with the invention the radiation or the light is transmitted from one single or common radiation source or light source to the radiation-distributing element formed as a spot and the current for the individual lighting means is not used as the energy carrier. What is important in the case of the system in accordance with the invention is the fact that a, for example, selectable portion of the parallel radiation delivered by the radiation source is branched off and directed to a desired location by means of a plurality of partially transparent mirrors, whilst the remaining portion of the radiation passes through the partially transparent mirror without hindrance and is transmitted to a further partially transparent mirror. As a result, in the case of the radiation-deflecting system in accordance with the invention it suffices to install one common radiation source, such as, for example, one light source, at a suitable location, whilst the corresponding forms of illumination for a lighting system are then effected by means of so-called radiation-distributing elements which comprise a partially transparent mirror as an important component thereof. As a result of choosing the degree of transparency of the partially transparent mirror in a corresponding manner, a correspondingly desired and necessary portion of the parallel radiation coming from the radiation source can be branched off to a desired location in each case. In particular, even in the case of renovation work and also the extension and re-building of buildings and other facilities, in this connection electrical installation work can be substantially reduced and no individual electrical lines to the lighting means need to be laid with great outlay either, since the common radiation source or light source is arranged and installed centrally at a suitable location. In addition, this system is not only flexible, but also easy to maintain, since after installation the maintenance work that is required is restricted to the installation location of the radiation source.

In the case of the radiation-deflecting system in accordance with the invention at least one optical element, which, if applicable, is exchangeable, such as a lens, filter, slide or the like, can preferably be connected downstream of each partially transparent mirror representing the core item of the radiation-distributing element. With the aid of these additional devices in the form of variable optical elements, the partial beam branched off by means of the partially transparent mirror can be concentrated or diffused and corresponding colour effects can be achieved with the aid of colour filters, or else slides in the branched-off path of radiation can be projected onto a desired location. These optical elements connected downstream of the partially transparent mirror can be selected freely as a function of the desired requirements and factors that exist in each case.

The respective partially transparent mirror can preferably be rotated about two axes which enclose an angle of 90° in relation to each other, with the one axis pointing in the direction of the supply beam and the angle of the mirror being variable in relation to the supply beam in the other axial direction so that, on the one hand, the semi-transparent mirror can be rotated and swivelled about the radiation axis of the parallel radiation and, on the other hand, furthermore, its angle can be changed in such a way that the partial radiation branched off herewith can be directed at the desired locations in a spatially variable manner.

In order to rotate the respective partially transparent mirror about the radiation axis, that is, the aforementioned first axis, a supporting and guiding device, which is curved and in particular is formed so as to be substantially semicircular, is preferably provided. This is configured in such a way that a range of rotation and swing that is as great as possible is covered thereby in a variable manner and yet an optically responsive configuration is still provided. This supporting and guiding device is preferably formed from a triangular profiled material.

In particular in accordance with the invention the radiation-deflecting system is designed in such a way that the supporting and guiding device can be mounted on a fixed surface, such as a wall, ceiling or the like, preferably by way of a telescopic connection. This telescopic connection is thus used so that the supporting and guiding device can be arranged at, in each case, a desired and variable distance away from a fixed surface in order to render possible fine adjustment of the arrangement in accordance with the invention.

For the purpose of fixing the position of the telescopic connection and the supporting and guiding device, an eccentric device is preferably provided so that the supporting and guiding device can be aligned and fixed in a reliable manner in the desired position in each case. In particular, such a connection makes it possible for the position to be fixed in a variable manner and the position can also be changed subsequently.

Advantageously, the optical elements, which are connected downstream of the partially transparent mirror, are mounted on a support in an adjustable manner. This support is preferably formed as a receiving rail. In this way, the position of the optical elements that are connected downstream of the partially transparent mirror and their coordination therewith can be changed and in particular it is also possible to exchange said optical elements so that the optical elements that are desired in each case can be selected and put together as a function of the intended application and predetermined mode of use.

In accordance with an advantageous development of the radiation-deflecting system in accordance with the invention, the rotational mountings for the partially transparent mirror and the support for the optical elements downstream thereof are combined to form a functional unit. The result of this is that the optical elements that are connected downstream, such as mirrors, lenses or the like, are automatically guided in relation to each other in accordance with the angle of reflection so that after their initial installation no further subsequent adjustments are required any more. The rotational mounting for the partially transparent mirror and the support for the optical elements downstream thereof are preferably connected by way of an articulated joint as a mechanical device so that the support for the optical elements is coupled in terms of movement with these rotational mountings by way of a mechanical system with corresponding coordination with the rotational position of the partially transparent mirror.

With the aid of this development in accordance with the invention, the device for providing rotational movement for the partially transparent mirror together with the optical elements connected downstream thereof not only constitutes a functional unit, but also a physical structural unit so that the assembly of the whole system is simplified to the effect that a complete radiation-distributing element, which can be matched and adapted to the desired requirements in each case, is designed and provided at the desired locations in each case. It is not therefore necessary to provide radiation-distributing elements that are individually configured for the respective intended application, but a basic structural form is obtained that can be altered as desired and can be matched to the application.

In the case of a lighting system, a high-intensity light source is preferably provided as the radiation source, which light source can be formed, for example, by an arc lamp, in particular a metal-halide lamp, an argon-sulphur lamp or the like, in particular, for example, even by feeding in sun light.

Of course, the essential radiation-deflecting system in accordance with the invention is also suitable for other types of radiation for the redirection thereof without the use of special light guides, and an infrared light source or the like, for example, can be provided at a suitable location as the radiation source.

In summary, the basic principle of the radiation-deflecting system in accordance with the invention can be seen in the fact that starting from a single radiation source, such as a light source, which emits parallel radiation or a parallel light beam, radiation is branched off at a plurality of predetermined and selectable locations in the course of the thus directed radiation with the aid of a plurality of partially transparent mirrors and this branched-off radiation is then directed to desired locations in a predetermined manner. As a result, an optically responsive radiation-deflecting system, in particular a lighting system, can be created that is extremely flexible and can be operated in an energy-saving manner and also in such a manner that it is easy to maintain.

BRIEF DESCRIPTION OF THE DRAWINGS

Further details, features and advantages of the invention emerge from the description which follows of preferred embodiments with reference to the enclosed drawing, in which.

Figure 1:
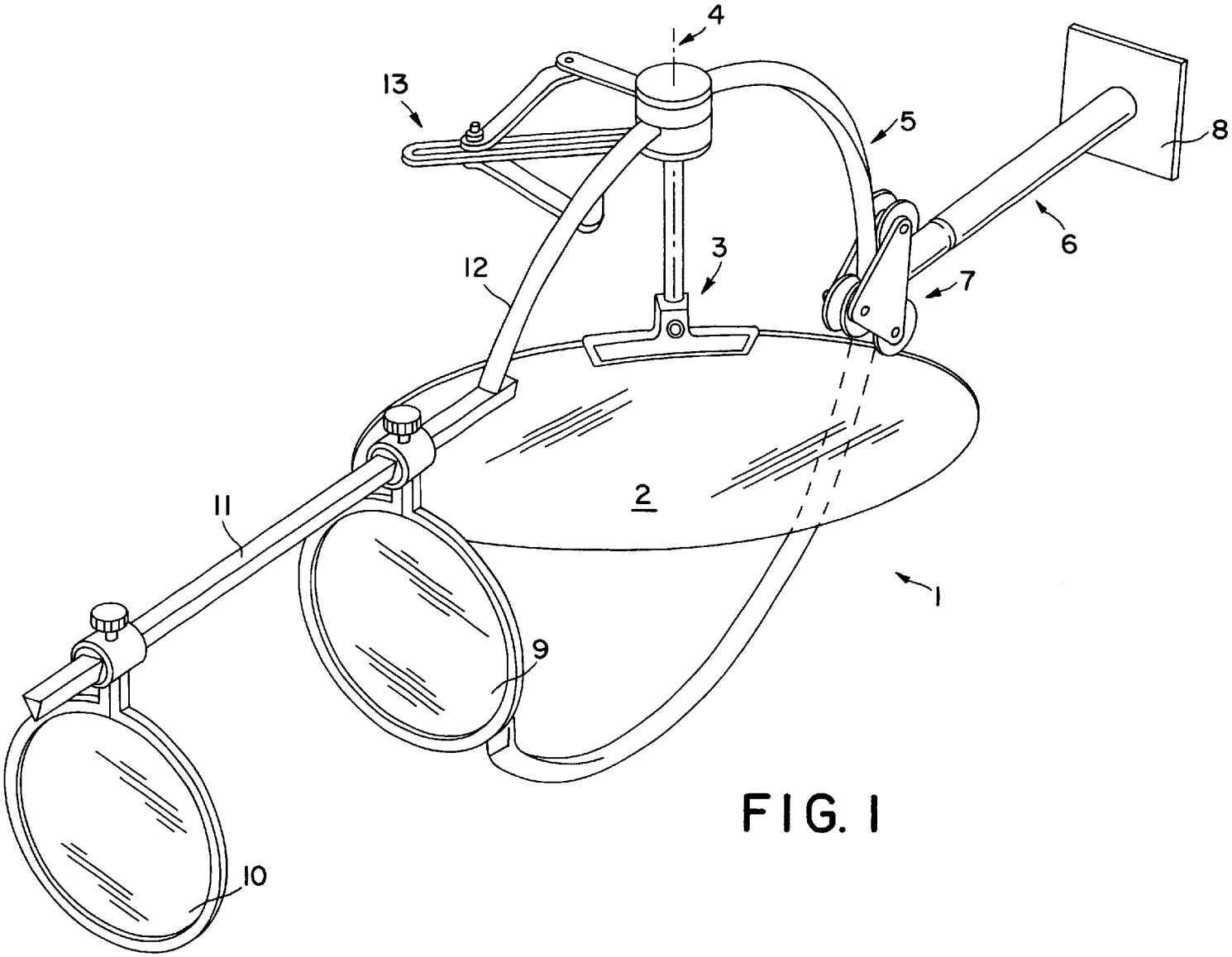
FIG. 1 shows a perspective diagrammatic view of a basic structural form of a radiation-distributing element showing the details thereof.

Of course, the examples shown in the drawing are only to be regarded as preferred embodiments and numerous modifications and alterations are possible that result in the radiation-deflecting system in accordance with the invention being almost universally variable with regard to the use and the concrete design form thereof.

DETAILED DESCRIPTION OF THE PREFERRED EMBODIMENTS

In FIG. 1 a radiation-distributing element, denoted as a whole with 1, is shown in a perspective view. An important component of this radiation-distributing element 1 is a partially transparent mirror 2 which is received in a mirror-holding support 3 in an exchangeable manner. The transparency of the partially transparent mirror 2 can be varied and as a function thereof it is possible to select the portion of the radiation that is branched off from the main radiation. As a result of the fact that the partially transparent mirror 2 is exchangeable, it is possible to exchange the latter in a simple manner for a partially transparent mirror with a different degree of transparency so that greater or smaller portions of radiation coming from a radiation source can be branched off by means of the radiation-distributing element 1.

The partially transparent mirror 2 is rotatable about a rotational axis 4 substantially perpendicularly in relation to the radiation axis. The rotational mounting of the partially transparent mirror 2 is connected to a supporting and guiding device 5 which is preferably formed so as to be curved and in particular is shaped so as to be substantially semicircular. Advantageously, this supporting and guiding device 5 is formed by a triangular profiled material. This supporting and guiding device 5 makes it possible for the partially transparent mirror 2 to be swivelled over a swivel arc, with the swivel arc embracing the whole width of radiation of the parallel radiation so that almost universal positioning of the partially transparent mirror 2 in relation to the path of radiation and the radiation axis is possible. This supporting and guiding device 5 can be mounted by means of a telescopic connection 6, preferably with use of an eccentric device 7, at a variable distance from a fixed surface 8 and in a position which can be varied in each case and is predetermined. A wall, ceiling or the like, for example, can constitute the fixed surface. Fine adjustment of the radiation-distributing element 1 is rendered possible with the aid of the telescopic connection 6.

In the case of the preferred basic embodiment of a radiation-distributing element 1 shown in FIG. 1, optical elements 9, 10 are connected downstream of the partially transparent mirror 2 and these can be arranged with predetermined interspacing in a variable manner. These optical elements 9, 10 are mounted in an adjustable manner on a support 11 which is provided therefor and which is formed, for example, as a receiving rail. This receiving rail preferably also has a triangular profiled section. This support 11 further comprises a bow which is connected to the rotational mounting in the region of the rotational axis 4 of the partially transparent mirror 2. The bow 12 is connected to the rotational mounting of the partially transparent mirror 2 by way of a mechanical system 13 which is in the form of a lever rod system.

As a result of these design details explained above, the rotational mounting (rotational axis 4) for the partially transparent mirror 2 and the support 11 for the optical elements 9, 10 downstream thereof are combined to form a functional unit which, however, also forms a physical unit. The coupling by way of the mechanical system 13 in particular allows the support 11 for the optical elements 9, 10 to be connected and coupled in terms of movement with the rotational mounting of the partially transparent mirror 2 with corresponding coordination with the rotational position of said partially transparent mirror 2 in such a way that the optical elements 9, 10, which are connected downstream, such as lenses, which can be dispersing lenses, focussing lenses, slides, filters, such as colour filters or the like, are always automatically moved at the correct angle (that is, in accordance with the angle of reflection) in relation to each other in a guided manner and thus the optical elements 9, 10 which are connected downstream are automatically brought into line with the respective position of the partially transparent mirror 2. As a result, individual adjustment work can be avoided and in particular adjustment to line up the radiation-distributing element can also be substantially facilitated.

By way of example, in FIG. 2 a radiation-distributing element 1, the details of which have been explained in greater detail with reference to FIG. 1, is arranged, as an example of application, in the path of radiation 16, such as a light beam, by means of which radiation-distributing element 1, a portion of the radiation that comes from a radiation source, which is not shown in greater detail, such as a high-intensity light source, in a form where it (the radiation) is directed in parallel, is branched off. An arc lamp, for example, can be provided as a high-intensity light source, which is not represented in greater detail, in a lighting system and is formed in particular by a metal-halide lamp, an argon-sulphur lamp or the like. If applicable, sun light can also be fed in.

Figure 2:
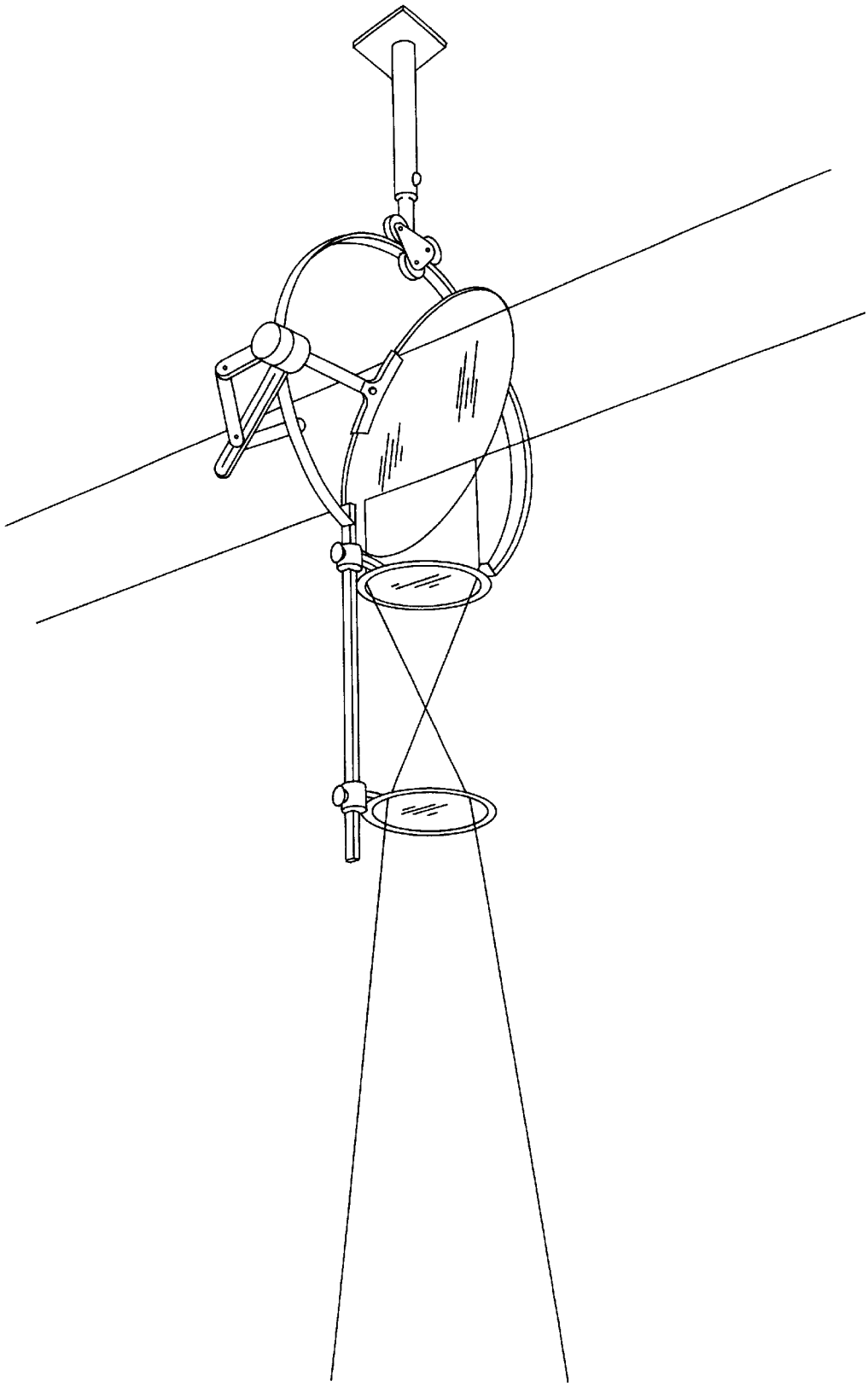
FIG. 2 shows a diagrammatic view for the purpose of illustrating an example of application of a radiation-path guide in the case of the radiation-deflecting system in accordance with the invention with use of a radiation-distributing element, designed, for example, in accordance with FIG. 1.

As can be seen from FIG. 2, a corresponding portion of the parallel radiation is branched off from the path of radiation 16 by means of the radiation-distributing element 1 and the partially transparent mirror 2 provided there and is directed in a predetermined manner to a desired location by way of the optical elements 9, 10 arranged on the support 11. By way of example, a radiation-distributing element 1 is shown there that is hung up on a ceiling surface as the fixed surface 8.

Figure 3:
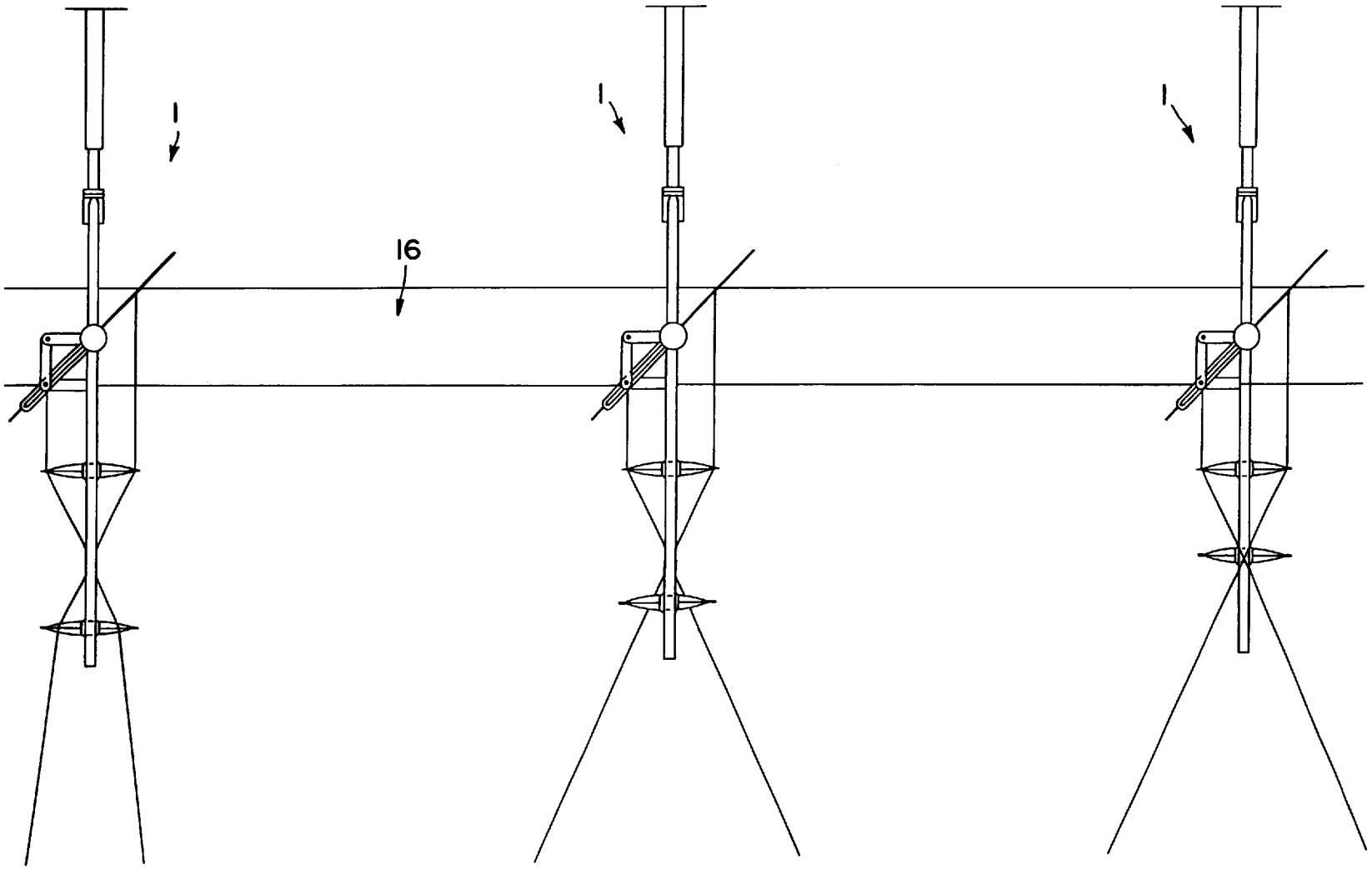
FIG. 3 shows a diagrammatic view of an embodiment of a radiation-deflecting system in accordance with the invention, in which, for example, three radiation distributing elements are arranged so as to be spaced apart over the course of the parallel radiation.

An arrangement can be seen from FIG. 3 that comprises a plurality of radiation-distributing elements 1, a basic embodiment of which elements has previously been explained by way of example with reference to FIG. 1. These radiation-distributing elements 1 are arranged so as to be spaced apart in the longitudinal direction of the path of radiation 16 and with the aid of the partially transparent mirrors respectively associated with the radiation-distributing elements a correspondingly desired portion of the radiation is branched off and, if applicable, directed to a desired location in the space by way of the optical elements 9, 10 provided, in which case in the representation in FIG. 3 a plurality of locations that are to be illuminated are also spaced apart. With the aid of such an arrangement, if applicable, slides and characters can also be illuminated and can be imaged with a lens connected downstream thereof as an optical element. In a similar manner, colour filters can also be used so that colour effects can be achieved in a desired manner with such a radiation-deflecting system.

Figure 4:
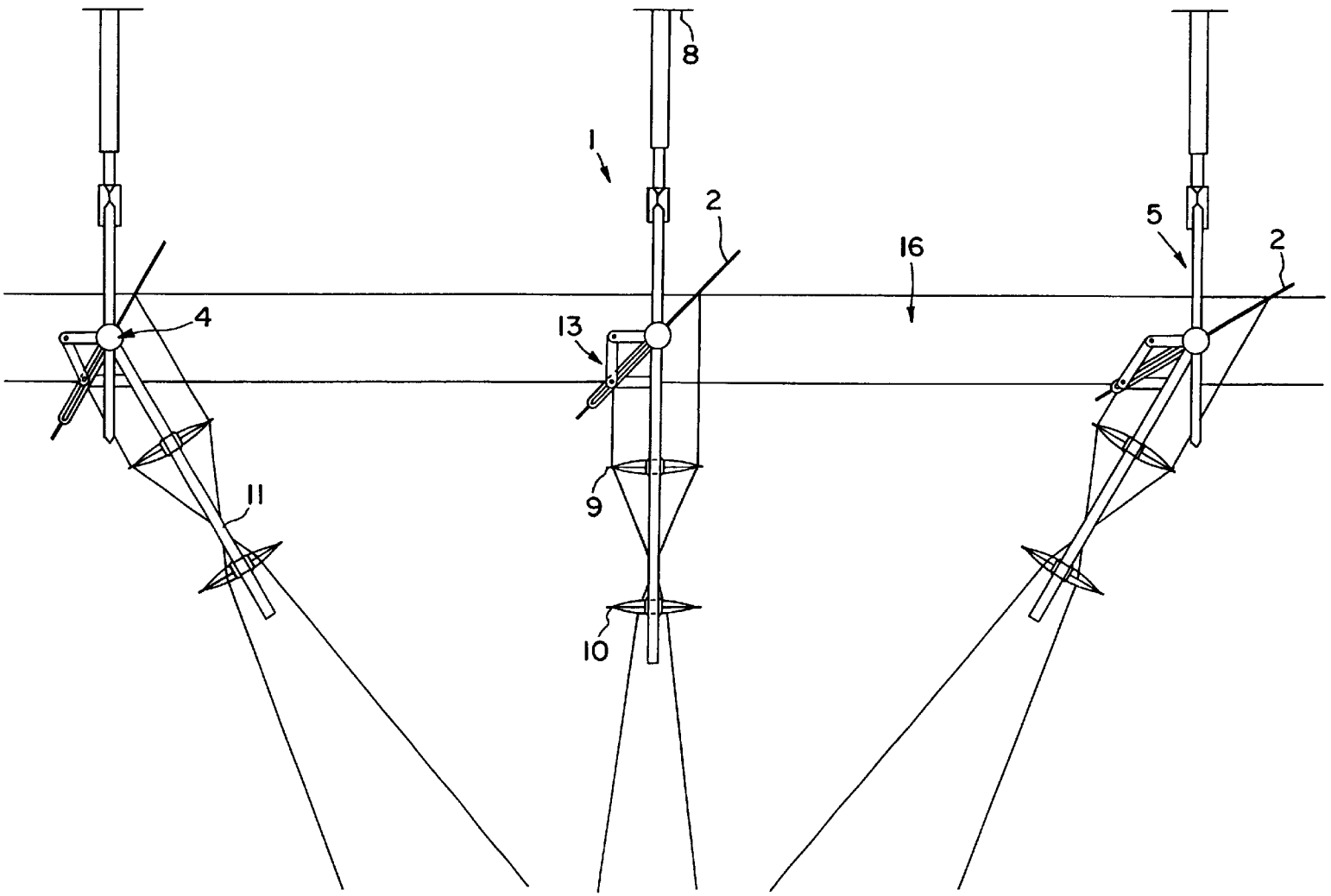
FIG. 4 shows a view of a further preferred embodiment of a radiation-deflecting system, in which the radiation that is branched off with the aid of the radiation-distributing elements is directed from various sides, concentrated, for example, onto a predetermined area.

A further design form is shown in FIG. 4 as an example of application of a radiation-deflecting system which likewise comprises a plurality of radiation-distributing elements 1 which have already been explained above. It can be seen from this that with the aid of the radiation-distributing element 1 an area that is almost the size of a hemisphere can be covered by means of corresponding swivelling movements about the two axes that are perpendicular to each other and that in this connection the partially transparent mirror 2 and the optical elements 9, 10, which, if applicable, are connected downstream thereof, are always guided together with the desired coordination with each other, something which is achieved with the aid of the connection that effects coupling in terms of movement, as explained above.

Of course, the embodiments described above only represent a small selection of examples which can be modified in any way and can be adapted to meet the requirements.

What is important in the case of the radiation-deflecting system in accordance with the invention is the fact that there is no electrical power supply to each lighting fixture or lighting means, but that there is one single common radiation source, such as a light source, which delivers parallel radiation, for example a light beam, in which case radiation is branched off from this directed radiation in a corresponding manner with the aid of one or more partially transparent mirrors 2 with the use of a radiation-distributing element 1 and this can then be deflected and directed in the desired manner with the aid of optical elements 9, 10 which may optionally be provided. The individual radiation-distributing elements 1 therefore dispense with a separate power supply so that it is also possible to use this radiation-deflecting system in an advantageous manner in the large-capacity range. When applied to a lighting system, it is possible to illuminate whole halls or stories with the aid of this system and good quality lighting is obtained with excellent reproduction of colour. If applicable, day light, such as sun light, can also be fed into the radiation-deflecting system in accordance with the invention, for which purpose, of course, corresponding devices must be provided in the region of the radiation source.

The invention is not limited to the details described above, but numerous alterations and modifications are possible which the person skilled in the art will make, if necessary, without departing from the idea of the invention.

What is claimed is:

1. In a radiation-deflecting system having at least one light radiation source which emits parallel radiation along a path having a radiation axis:

a plurality of partially transparent mirrors which are spaced apart along said path of radiation of the radiation source, said partially transparent mirrors being rotatable with respect to the radiation axis as radiation-distributing elements to direct portions of the light radiation from said path to predetermined desired locations; and a supporting and guiding device mounted to permit rotation of an associated partially transparent mirror with respect to the radiation axis, said supporting and guiding device being curved and formed so as to be substantially semicircular.

2. Radiation-deflecting system according to claim 1, further including:

at least one optical element mounted downstream of each partially transparent mirror.

3. Radiation-deflecting system according to claim 2, wherein:

the optical elements which are connected downstream of at least one associated partially transparent mirror, are adjustably mounted on a support.

4. Radiation-deflecting system according to claim 3, wherein:

the support is formed as a receiving rail.

5. Radiation-deflecting system according to claim 3, wherein:

the rotational mounting for the partially transparent mirror and the support for the optical elements downstream thereof are combined to form a functional unit.

6. Radiation-deflecting system according to claim 3, wherein:

a mechanism is arranged to couple the support for the optical elements with the rotational mounting for the associated partially transparent mirror in a manner to coordinate the movements of said optical elements with the rotational position of their respective partially transparent mirror.

7. Radiation-deflecting system according to claim 2, wherein:

the optical elements are exchangeable.

8. Radiation-deflecting system according to claim 2, wherein:

said optical elements are selected from the group consisting of at least one of a lens, a filter and a slide.

9. Radiation-deflecting system according to claim 1, wherein:

at least one of said partially transparent mirrors is rotatable about a second axis which extends perpendicularly in relation to said radiation axis, said at least one partially transparent mirror being mounted so that its position can be varied at an angle relative to said second axis.

10. Radiation-deflecting system according to claim 1, wherein:

the supporting and guiding device is constructed to be mounted on a fixed surface, such as a wall, ceiling or the like.

11. Radiation-deflecting system according to claim 10, further including:

an eccentric device, said eccentric device being constructed and arranged to fix the position of the telescopic connection and the supporting and guiding device.

12. Radiation-deflecting system according to claim 1, wherein:

said system is arranged to be used with a high intensity light source such as an arc lamp, a metal-halide lamp, an argon-sulphur lamp or the like.

13. Radiation-deflecting system according to claim 1, wherein:

said system is arranged to be used with an infrared light source.

14. Radiation-deflecting system according to claim 1, wherein:

said system is arranged to be used with sun light as the radiation source.

* * * * *